US010156374B2

(12) United States Patent
Berto et al.

(10) Patent No.: US 10,156,374 B2
(45) Date of Patent: Dec. 18, 2018

(54) PANED WINDOWS AND DOORS IN WHICH THERE IS A PLURALITY OF PELTIER CELLS

(71) Applicants: Giampaolo Berto, Vicenza, Thiene (VI) (IT); Silvano Vignaga, Vicneza, Brendola (VI) (IT); Silvano Munaretto, Thiene (VI) (IT)

(72) Inventors: Giampaolo Berto, Thiene (VI) (IT); Silvano Vignaga, Brendola (VI) (IT)

(73) Assignees: Giampaolo Berto, Thiene (VI) (IT); Silvano Vignaga, Brendola (VI) (IT); Silvano Munaretto, Thiene (VI) (IT)

( * ) Notice: Subject to any disclaimer, the term of this patent is extended or adjusted under 35 U.S.C. 154(b) by 69 days.

(21) Appl. No.: 15/123,772

(22) PCT Filed: Mar. 4, 2015

(86) PCT No.: PCT/EP2015/054544

§ 371 (c)(1),
(2) Date: Sep. 6, 2016

(87) PCT Pub. No.: WO2015/132308

PCT Pub. Date: Sep. 11, 2015

(65) Prior Publication Data

US 2017/0016639 A1 Jan. 19, 2017

(30) Foreign Application Priority Data

Mar. 5, 2014 (IT) ..... VI2014A0050

(51) Int. Cl.

| | |
|---|---|
| ***F24F 5/00*** | (2006.01) |
| ***E06B 7/28*** | (2006.01) |
| ***E06B 3/67*** | (2006.01) |

(52) U.S. Cl.
CPC ..... *F24F 5/0042* (2013.01); *E06B 3/6715* (2013.01); *E06B 7/28* (2013.01);
(Continued)

(58) Field of Classification Search
CPC ..... F24F 5/0042; F24F 5/0078
See application file for complete search history.

(56) References Cited

U.S. PATENT DOCUMENTS 7,570,338 B2 8/2009 Yoon et al.
8,643,933 B2 * 2/2014 Brown ..... H01R 41/00 359/275

(Continued)

FOREIGN PATENT DOCUMENTS

DE 2605309 A1 * 8/1977 ..... E06B 3/6715
DE 102012208406 A 11/2013

(Continued)

OTHER PUBLICATIONS

International Search Report of PCT/EP2015/054544 in English, dated Jul. 7, 2015.

*Primary Examiner* — Christopher R Zerphey
(74) *Attorney, Agent, or Firm* — Bucknam and Archer

(57) ABSTRACT

There is provided a paned window or door structure in which a plurality of Peltier cells are present. The paned elements have a frame with a fixed portion (2') and a mobile portion (2") in which at least one double glazing unit (3) is present, it being provided that in the interspace present in the double glazing unit, at an edge that is arranged in the mobile portion (2") of the frame, a plurality of Peltier cells (11) are present. The Peltier cells are in contact with an element for dissipating heat towards the outside (12), made of optimal heat conduction material, which has a portion thereof (12') arranged at the external surface of the door or window. On each of the cells (11), a sheet is superimposed made of material with high heat conductivity, acting as a heat sink (Continued)

(13) for dissipating towards the interior of the double glazing unit.

4 Claims, 5 Drawing Sheets

(52) U.S. Cl.
CPC .... *F24F 5/0089* (2013.01); *F24F 2005/0067* (2013.01); *F24F 2005/0078* (2013.01)

(56) References Cited

U.S. PATENT DOCUMENTS

| | | | | |
|---|---|---|---|---|
| 2008/0236654 | A1* | 10/2008 | Pietrangelo | E06B 3/68 136/251 |
| 2015/0285540 | A1 | 10/2015 | Licht et al. | |

FOREIGN PATENT DOCUMENTS

| | | | | |
|---|---|---|---|---|
| EP | 0061989 | A | 10/1982 | |
| FI | 89337 | A | 6/1993 | |
| GB | 1169556 | A | 11/1969 | |
| GB | 2424059 | U | 9/2006 | |
| KR | WO 2015190803 | A1 * | 12/2015 | E06B 3/67 |
| WO | 2011/110988 | A | 9/2011 | |

* cited by examiner

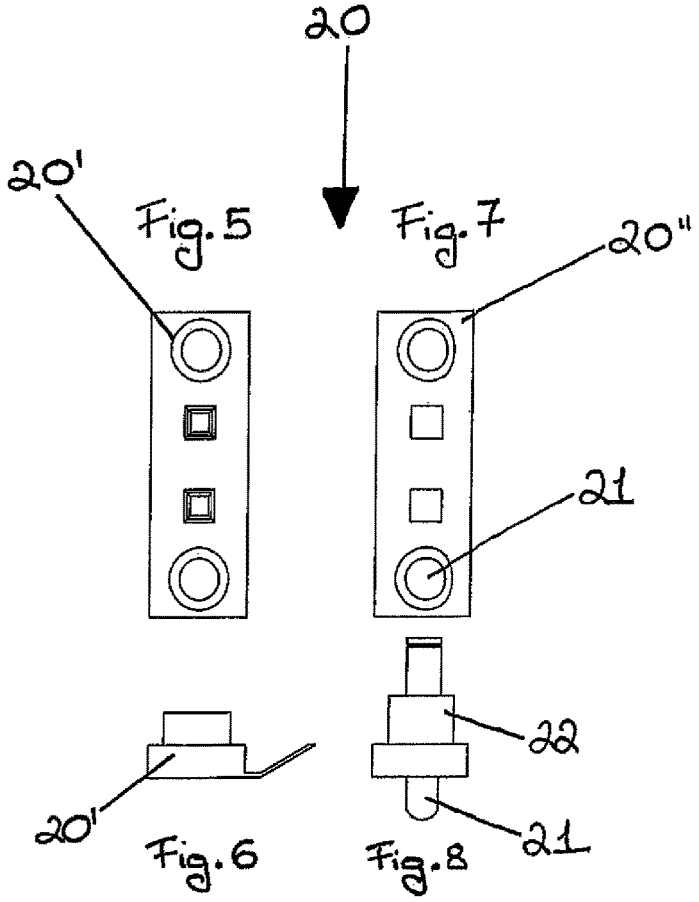
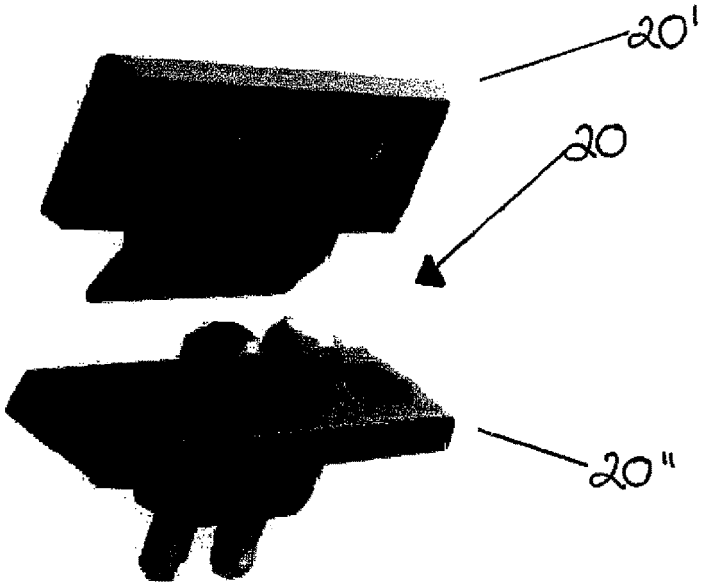
Fig. 9

PANED WINDOWS AND DOORS IN WHICH THERE IS A PLURALITY OF PELTIER CELLS

CROSS REFERENCE TO RELATED APPLICATIONS

This application is the National Stage of PCT/EP2015/054544 filed on Mar. 4, 2015, which claims priority under 35 U.S.C. § 119 of Italian Application No. VI2014A000050 filed on Mar. 5, 2014, the disclosures of which are incorporated herein by reference. The international application under PCT article 21(2) was published in English.

The present invention regards paned windows and doors in which there is a plurality of Peltier cells, according to the general part of claim 1.

It is known that, especially over the last years, devices and systems have been conceived that are adapted to reduce the energy consumed for heating offices, civil and community environments and the like.

On the one hand, this is due to the cost of the energy sources, which tends to continue to increase or remains substantially high; such sources generally consist of methane gas, heating petrol and charcoal in some countries or, alternatively, electrical energy in case of use of heat pumps or normal electrical heaters for such environments.

In addition, besides this economic factor, which is also extremely important, it should be observed that there is an attempt to reduce energy consumption for heating domestic environments and the like with the aim of reducing the emission of carbon dioxide into the atmosphere, which causes the "greenhouse effect". Such emissions are always somehow related to the consumption of fossil fuels, directly in case of combustion of the aforementioned in loco, or indirectly in cases where the appliance utilises the electrical energy from the supply system.

The various attempts aimed at attaining the aforementioned objects are included in the following patent documents:

EP 0061989 A1, FI 89337 A, GB 2424059 A, WO 2011/110988 A, GB 1169556 A and DE 102012208406 A1.

These documents describe devices utilising Peltier cells.

However, in such documents the cells were inserted into paned doors and windows in which air flows are channelled through climate-control systems. In other words, these Peltier cells present in the devices of the known type essentially serve as accessory elements for heating/cooling the previously climate-controlled air through air conditioners, heat pumps, heaters and other similar devices of the known type.

It is known that the Peltier cells are thermo-electric devices constituted by many joints arranged in series. Actually, said cells are basically heat pumps in the solid state, which have the aspect of a thin plate. As a matter of fact, one of the two surfaces of the cell absorbs the heat, while the other emits heat.

The main characteristic of these cells actually consists of the fact that the direction with which the heat is transferred depends on the direction of the direct current applied to the terminals of the plate. In practice, inverting the direction of the direct current which traverses the cell also allows inverting the direction of the transferred heat; thus, if with one direction of such current one of the two surfaces is heated and the other is cooled, the reversal of the direction of the current reverses the heated and cooled surfaces.

An object of the present invention is that of providing doors and windows and paned doors and windows within which there is a plurality of Peltier cells, wherein said cells are capable of effectively acting, without external help, as elements for the main climate control of the environments in which such doors and windows are arranged.

According to the invention, this is obtained by shaping the doors and windows and paned doors and windows in which there is a plurality of Peltier cells according to the characteristics of the characterising part of claim 1.

These and other characteristics of the device according to the invention are described in the dependent claims.

These and other characteristics of the invention shall be described hereinafter in detail, with reference to some embodiments of the invention, with the help of the attached drawings, wherein.

FIGS. 5, 6 and, respectively, 7 and 8 show two views of the mobile and fixed contacts for supplying current to the Peltier cells present in a door and window according to the invention;

FIG. 9 illustrates an overall views of said two contacts.

Figure 1:
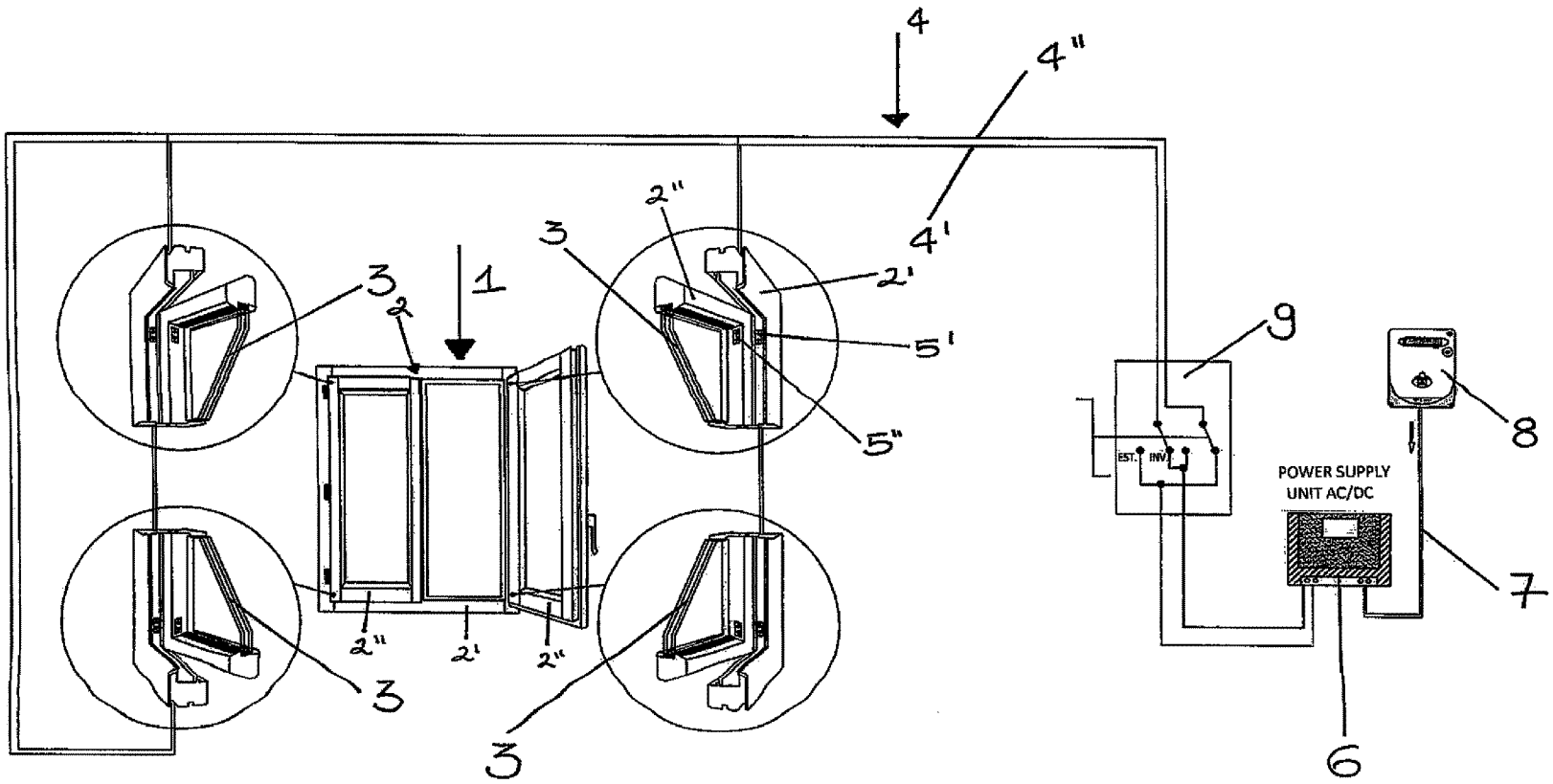
FIG. 1 illustrates a schematic view of a paned door and window obtained according to the invention, supplied through an electrical power supply system.

With reference to FIG. 1, it is observed that a paned door and window 1 according to the invention (but the description below may easily refer to any type of paned door and window) has, as usually, a frame 2, with a fixed portion 2' and a mobile portion 2", in which there is at least one double glazing unit 3.

A main characteristic of the device according to the invention lies in the fact that, as better observable in the FIGS. that follow, in the frame there is a plurality of Peltier cells. In order to power supply the latter, an electric circuit 4 is provided with at least two conductors 4', 4", which power supply said Peltier cells through contact pairs, respectively fixed and mobile 20', 20", respectively present in the fixed frame 2' and mobile frame 2". Said contacts 20', 20" shall be better illustrated and described hereinafter.

The electrical circuit 4 is supplied through a power supply unit 6, which transforms the alternating current coming from the electrical mains 7 (through a usual electricity meter 8) in direct current.

Reference 9 indicates an inverter, capable of inverting the direction of the current that supplies the Peltier cells, essentially to pass from the summer position to the winter position in that, as known, according to such inversion—given that the Peltier cells are of the reversible type—the surfaces of the plates of the aforementioned invert their cold/hot state.

Figure 2:
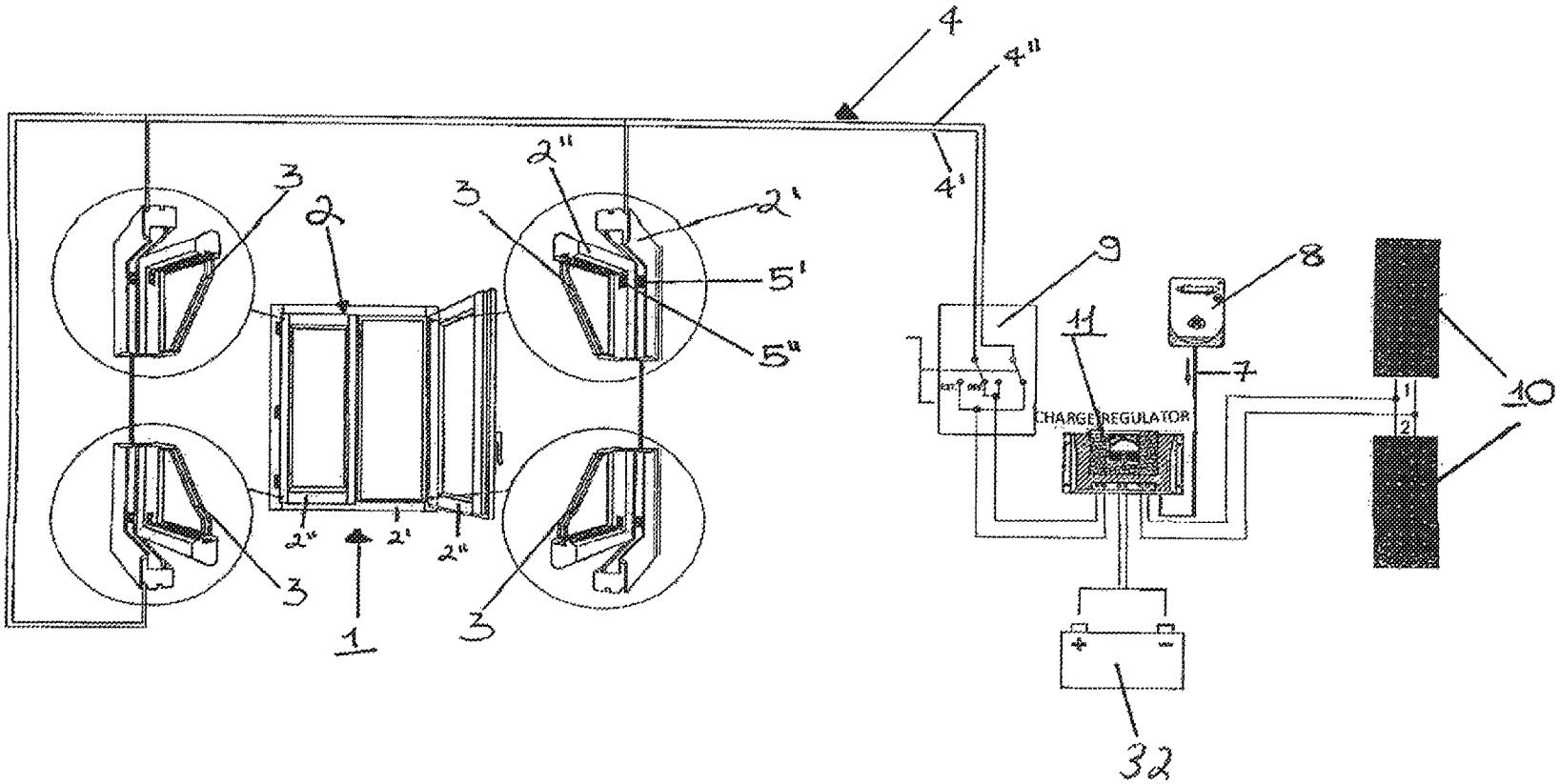
FIG. 2 illustrates the same door and window, supplied through photovoltaic panels.

FIG. 2 shows a door or window according to the invention, but power supplied through a battery of photovoltaic panels 10 in this case.

In this case, as usual, they serve as support for the electrical power supply of the mains 7; a load regulator 11 is advantageously provided, adapted to accurately determine the electric circuit 4 supply voltage, said load regulator in turn being connected, in a per se known manner, to an direct-current accumulator 32.

Figure 3:
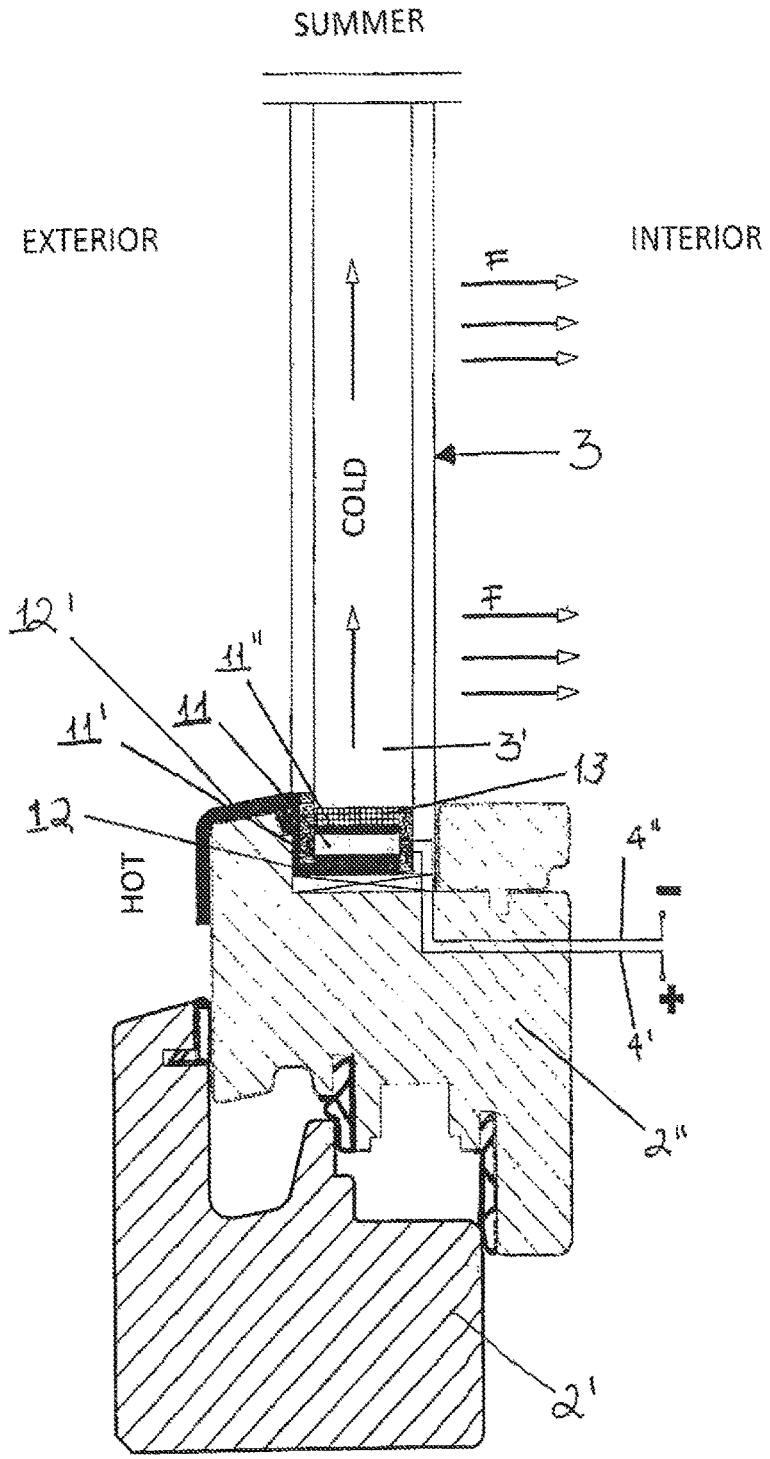
FIG. 3 illustrates a transverse sectional view of a portion of a door and window according to the invention, which operates during summer.

FIG. 3 shows that, according to the invention, it is provided for that the Peltier cells 11 be arranged in the interspace 3' present in the double glazing unit 3 at an edge of the aforementioned, arranged in the mobile frame 2".

This figure also shows that the cell 11 is power supplied by the two conductors 4' and 4".

This Peltier cell is surmounted, at the inner part of the double glazing unit, by a first heat sink 13, made of material with high heat conductivity. Conversely, below the cell 11, interposed between it and the mobile frame 2" of the double glazing unit, a further heat sink 12 is present, also made of high heat conductivity material, which also continues towards the exterior with the portion 12' thereof acting as a heat sink, surmounting a portion of the external surface of the mobile frame 2".

In practice, in the operation of the device illustrated in FIG. 3, which essentially refers to summer, the surface of the Peltier cell 11" arranged towards the double glazing unit is intended to be cooled, determining the cooling of the air contained in the double glazing unit and thus the introduction of "cold air" towards the interior of the environment closed double glazing unit.

At the same time, the heat generated in the hot surface 11' of the Peltier cell is brought towards the exterior, to be dispersed through the portion 12', which acts as a heat sink towards the external.

Obviously, the surface 11" of the cell, which is on the contrary cooled, introduces the "cold air" into the double glazing unit through an inward heat sink 13.

Figure 4:
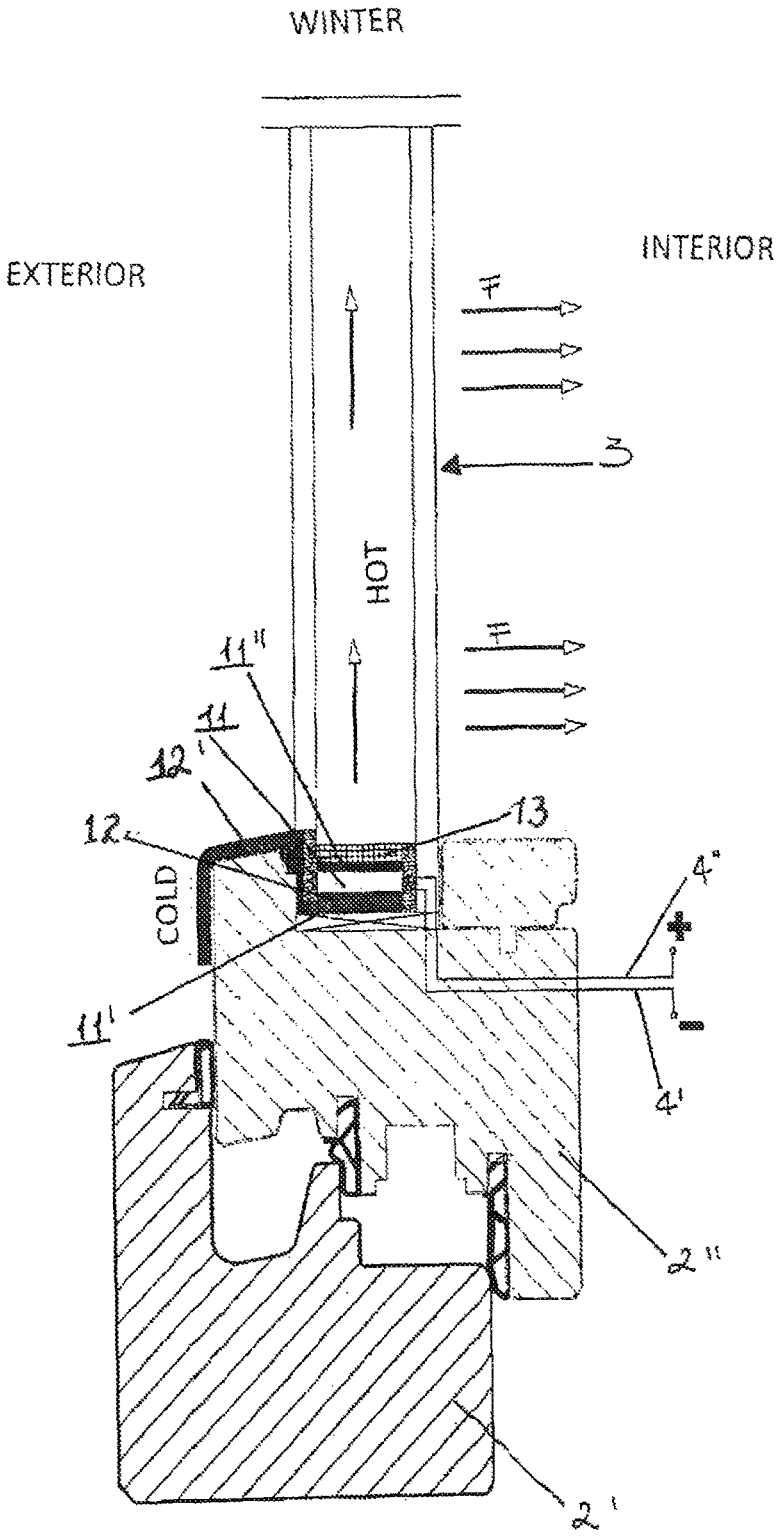
FIG. 4 illustrates the same door and window, which operates during winter.

Conversely, with reference to FIG. 4, which refers to the operation of the device in winter, it is immediately observable that the polarity of the conductors 4' and 4" is now inverted, this determining that towards the interior there is now the "hot air" (arrows F), same case applying to the interior of the double glazing unit through an inward heat sink 13.

This is obviously due to the fact that the Peltier cell 11 has the surface 11" towards the interior of the "hot" double glazing unit, while the face 11' arranged towards the edge of the frame is "cold" and the cold air is taken towards the exterior through the portion 12', which acts as an outward heat sink.

Tests carried out allowed verifying that by using a suitable number of Peltier cells, it is possible to obtain ideal climate control of the environment, said cells being inserted in the doors and windows.

Advantageously, it was verified that each door is advantageously provided with two Peltier cells continuously supplied with a current of about 1 A to about 4 Vcc. This regardless of whether one wishes to cool or heat the environment, obviously with reference to a normal temperate climate. However, there is no construction, structural or functional limitation to having a higher number of Peltier cells on each door, in relation to possible more extreme climates in which the environment to be climate-controlled is placed.

FIGS. 5 to 9 advantageously show that the supply of the electrical current to the Peltier cells is guaranteed through electrical currents, of per se known type, indicated in their entirety with reference 20, having portions 20' arranged on the fixed frames 2' (FIG. 1), while the portions 20" are arranged on the mobile frames 2" (FIG. 1).

The mobile portions 20" have contacts 21 intended to slide in their seat 22, in relation to the contact generated between the aforementioned and the corresponding "fixed contact portions 20'.

The invention claimed is:

1. A paned window or door structure including a system for environmental climate control, said paned window or door structure including a frame (2) having a fixed frame portion (2') and a mobile frame portion (2") wherein said mobile frame portion (2") defines a recessed channel having an upper limit and adapted to receive therein a perimetric edge of a double glazing unit (3) which defines between the glass panes a gap (3'), said environmental climate control system comprising:

in combination, a plurality of Peltier cells (11) arranged along the perimetric edge of said double glazing unit (3) and disposed within the gap (3') between the glass panes of said double glazing unit (3), a first heat sink element (12) disposed in contact with a lower surface of said Peltier cells (11) for thermal dissipation towards an exterior formed from a material of high heat conductivity and having a portion (12') arranged at an outer surface of said mobile frame portion (2"), a second heat sink element (13) disposed in contact with an upper surface of said Peltier cells (11) for thermal dissipation towards the gap (3') between the glass panes of said double glazing unit (3) formed from a material of high heat conductivity, said combination of Peltier cells (11), first heat sink element (12), and second heat sink element (13) being disposed at the perimetric edge of said double glazing unit (3) so as to not project above the recessed channel upper limit of said mobile frame portion (2"); and an electric circuit (4) for supplying electric power to said Peltier cells (11) including first contacts (20') arranged on said fixed frame portion (2') and complimentary second contacts (20") arranged on said mobile frame portion (2"), and an inverter (9) adapted to invert the electric power supplied to said Peltier cells (11) so as to reverse a heating/cooling mode between the upper and lower surfaces of said Peltier cells.

2. The paned window or door structure according to claim 1, wherein said electric circuit (4) for powering said Peltier cells (11) is powered through a power supply (6) adapted to convert alternating current from electrical mains (7) into direct current.

3. The paned window or door structure according to claim 1, wherein said electric circuit (4) is powered through a battery of photovoltaic panels (10), and a charge regulator (11) for determining the power supply voltage of said circuit, said charge regulator being connected to a DC accumulator (32).

4. The paned window or door structure according to claim 1, wherein electric current to said Peltier cells (11) is provided via contact elements (20) having first contacts (20') arranged on said fixed frame portion (2') which contact with second contacts (20") arranged on said mobile frame portion (2"), said second contacts (20") having contact portions (21) adapted to slide in a seat (22) in relation to the contact generated between second contacts (20") and first contacts (20') arranged on said fixed frame portion (2').

* * * * *